US009695540B2

(12) United States Patent
Leibman et al.

(10) Patent No.: US 9,695,540 B2
(45) Date of Patent: Jul. 4, 2017

(54) DISPENSING APPARATUS WITH LABYRINTH SEAL

(71) Applicant: General Electric Company, Schenectady, NY (US)

(72) Inventors: Alexander Boris Leibman, Prospect, KY (US); Taranjeet Singh, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 444 days.

(21) Appl. No.: 14/289,767

(22) Filed: May 29, 2014

(65) Prior Publication Data

US 2015/0345069 A1 Dec. 3, 2015

(51) Int. Cl.
*D06F 39/02* (2006.01)
*D06F 23/04* (2006.01)

(52) U.S. Cl.
CPC ..... *D06F 39/022* (2013.01); *D06F 23/04* (2013.01)

(58) Field of Classification Search
USPC ..... 68/17 R, 207; 134/93
See application file for complete search history.

(56) References Cited

U.S. PATENT DOCUMENTS

| | | | |
|---|---|---|---|
| 4,974,750 | A | 12/1990 | Welch |
| 6,227,012 | B1 | 5/2001 | Borroni et al. |
| 7,313,934 | B2 | 1/2008 | Heo et al. |
| 7,428,831 | B2 | 9/2008 | Cho et al. |
| 7,481,082 | B2 | 1/2009 | Cho et al. |
| 7,654,119 | B2 | 2/2010 | Song |
| 7,805,964 | B2 | 10/2010 | Park |
| 7,934,403 | B2 | 5/2011 | Cho et al. |
| 2005/0229645 | A1 | 10/2005 | Kim et al. |
| 2005/0229652 | A1 | 10/2005 | Kim et al. |
| 2005/0241072 | A1 | 11/2005 | Kim et al. |
| 2005/0274156 | A1 | 12/2005 | Yang |
| 2007/0056328 | A1 | 3/2007 | Song |
| 2007/0056330 | A1 | 3/2007 | Song |
| 2007/0079637 | A1 | 4/2007 | Song |
| 2008/0072631 | A1 | 3/2008 | Je et al. |
| 2008/0072632 | A1 | 3/2008 | Je et al. |
| 2008/0078211 | A1 | 4/2008 | Je et al. |
| 2011/0277515 | A1 | 11/2011 | Doh |
| 2012/0017653 | A1 | 1/2012 | Doh |
| 2012/0167637 | A1 | 7/2012 | Mun et al. |

FOREIGN PATENT DOCUMENTS

| | | | |
|---|---|---|---|
| FR | 2582688 | A1 | 12/1986 |
| GB | 2165267 | A | 4/1986 |
| JP | 2009095586 | | 5/2009 |
| WO | WO 2006/008773 | A1 | 1/2006 |
| WO | WO 2007/124799 | A1 | 11/2007 |
| WO | WO 2010/003961 | A1 | 1/2010 |
| WO | WO 2011/080181 | A1 | 7/2011 |

(Continued)

*Primary Examiner* — Michael Barr
*Assistant Examiner* — Rita Adhlakha
(74) *Attorney, Agent, or Firm* — Dority & Manning, P.A.

(57) ABSTRACT

A fluid additive dispenser for a washing machine appliance is provided. The dispenser includes a housing, a dispenser drawer, and a plate. The housing and the plate form a seal to prevent water introduced into the dispenser from prematurely entering a compartment and to prevent a fluid additive in one compartment of the dispenser drawer from entering another compartment.

10 Claims, 5 Drawing Sheets

(56) References Cited

FOREIGN PATENT DOCUMENTS

| | | | |
|---|---|---|---|
| WO | WO 2012/084487 | A1 | 6/2012 |
| WO | WO 2012/114722 | A1 | 8/2012 |
| WO | WO 2013/098005 | A1 | 7/2013 |
| WO | WO 2013/105755 | | 7/2013 |
| WO | WO 2013/169005 | A1 | 11/2013 |

DISPENSING APPARATUS WITH LABYRINTH SEAL

FIELD OF THE INVENTION

The subject matter of the present disclosure relates generally to fluid additive dispensers for appliances, e.g., washing machine appliances.

BACKGROUND OF THE INVENTION

Washing machine appliances generally form wash and rinse fluids to clean clothing articles disposed within a wash basket of the appliance. The wash fluid can include, for example, water and various fluid additives, e.g., detergent, fabric softener, and/or bleach. The fluid additives can be mixed with water within a wash tub of the appliance to form the wash fluid. Various fluid additives may also be added to water to form the rinse fluid.

To introduce one or more fluid additives into the wash tub, a user can manually add the fluid additive to the wash tub and/or the wash basket. For example, after starting the appliance, the user can pour detergent directly into the wash basket. Conversely, certain washing machine appliances include features for receiving fluid additives and dispensing the fluid additives during operation of the appliance. For example, a tray may be mounted to or directly beneath top panel of a vertical axis washing machine appliance that can receive a fluid additive and direct the fluid additive into a wash tub of the appliance. Similarly, a horizontal axis washing machine appliance can include a drawer with a container mounted therein that receives a fluid additive and directs the fluid additive into a wash tub of the appliance.

Such trays or drawers may contain one or more compartments for the receipt of one or more fluid additives. The fluid additive contained in a compartment is flushed from the compartment into the wash tub of the appliance through an influx of water into the compartment. Usually, each fluid additive is directed to the wash tub at a different point in the wash cycle. Thus, the water introduced to flush one compartment should not enter any other compartment, and the fluid additive in one compartment should not enter any other compartment.

Accordingly, a washing machine appliance having a fluid additive dispenser would be useful. More particularly, a washing machine appliance having a fluid additive dispenser that seals one compartment of the dispenser from another compartment of the dispenser without e.g., welding or gluing parts of the dispenser would be useful.

BRIEF DESCRIPTION OF THE INVENTION

The present invention provides a fluid additive dispenser for a washing machine appliance. More particularly, the present invention provides a fluid additive dispenser for a washing machine appliance that includes a housing, a dispenser drawer, and a plate. The housing and the plate form a seal to prevent water introduced into the dispenser from prematurely entering a compartment and to prevent a fluid additive in one compartment from entering another compartment. Additional aspects and advantages of the invention will be set forth in part in the following description, or may be apparent from the description, or may be learned through practice of the invention.

In a first exemplary embodiment, the present invention provides a washing machine appliance. The appliance defines a vertical direction and includes a cabinet; a wash tub located within the cabinet; a wash basket rotatably mounted within the wash tub; and a fluid additive dispenser. The fluid additive dispenser includes a housing having an upper surface and a lower surface, and the upper surface defines a plurality of upper surface projections extending downwardly along the vertical direction. The fluid additive dispenser also includes a dispenser drawer slidably received in the housing, and the dispenser drawer has a plurality of compartments for the receipt of one or more fluid additives. The fluid additive dispenser further includes a plate disposed in the housing below the upper surface. The plate defines a plurality of plate projections extending upwardly along the vertical direction, and at least one upper surface projection is located between each adjacent pair of plate projections.

In another exemplary embodiment, a fluid dispenser for an appliance is provided. The dispenser defines a vertical direction and includes a housing having an upper surface and a lower surface. The upper surface defines a plurality of upper surface projections extending downwardly along the vertical direction. The dispenser also includes a dispenser drawer slidably received in the housing and having a plurality of compartments for receipt of one or more fluid additives. The dispenser further includes a plate disposed in the housing below the upper surface. The plate has a plurality of plate projections extending upwardly along the vertical direction and a plurality of relief slots defined between adjacent plate projections. At least one upper surface projection is located between each adjacent pair of plate projections.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
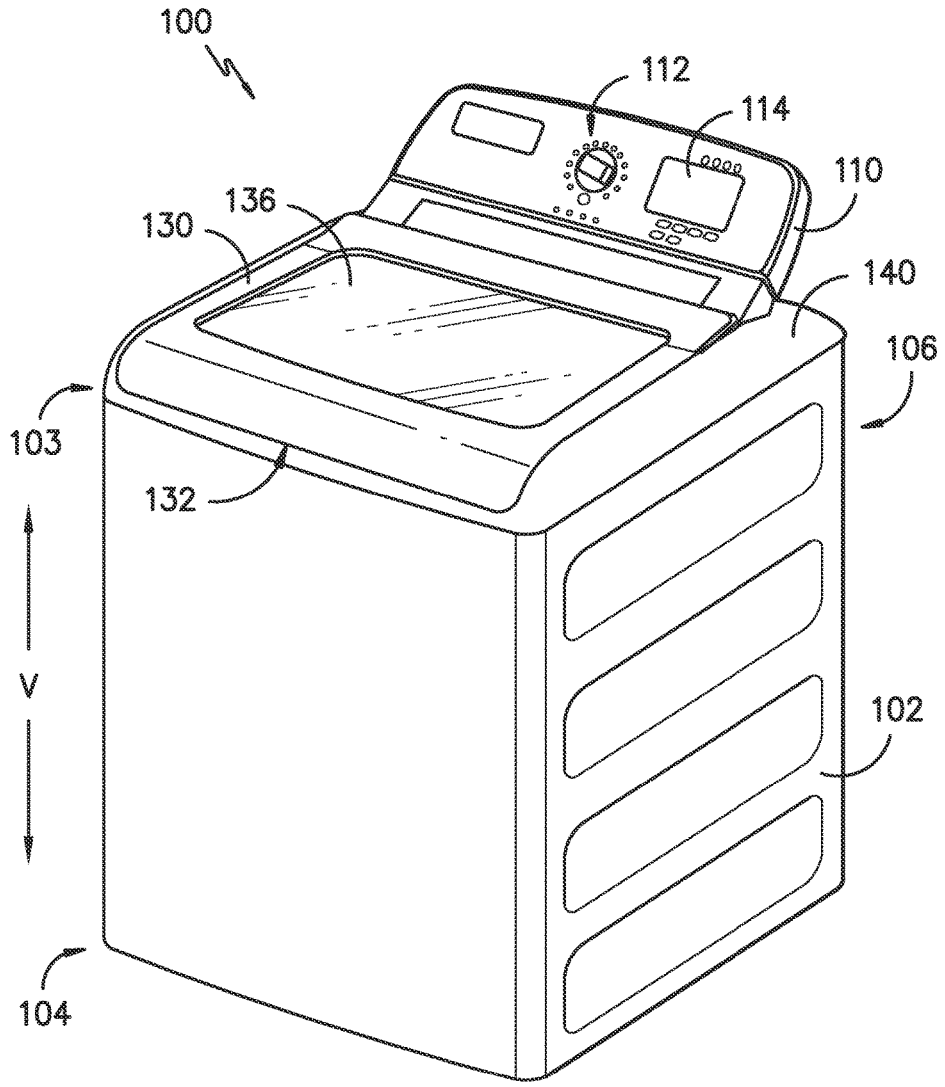
FIG. 1 illustrates an exemplary embodiment of a washing machine appliance of the present invention with a door shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
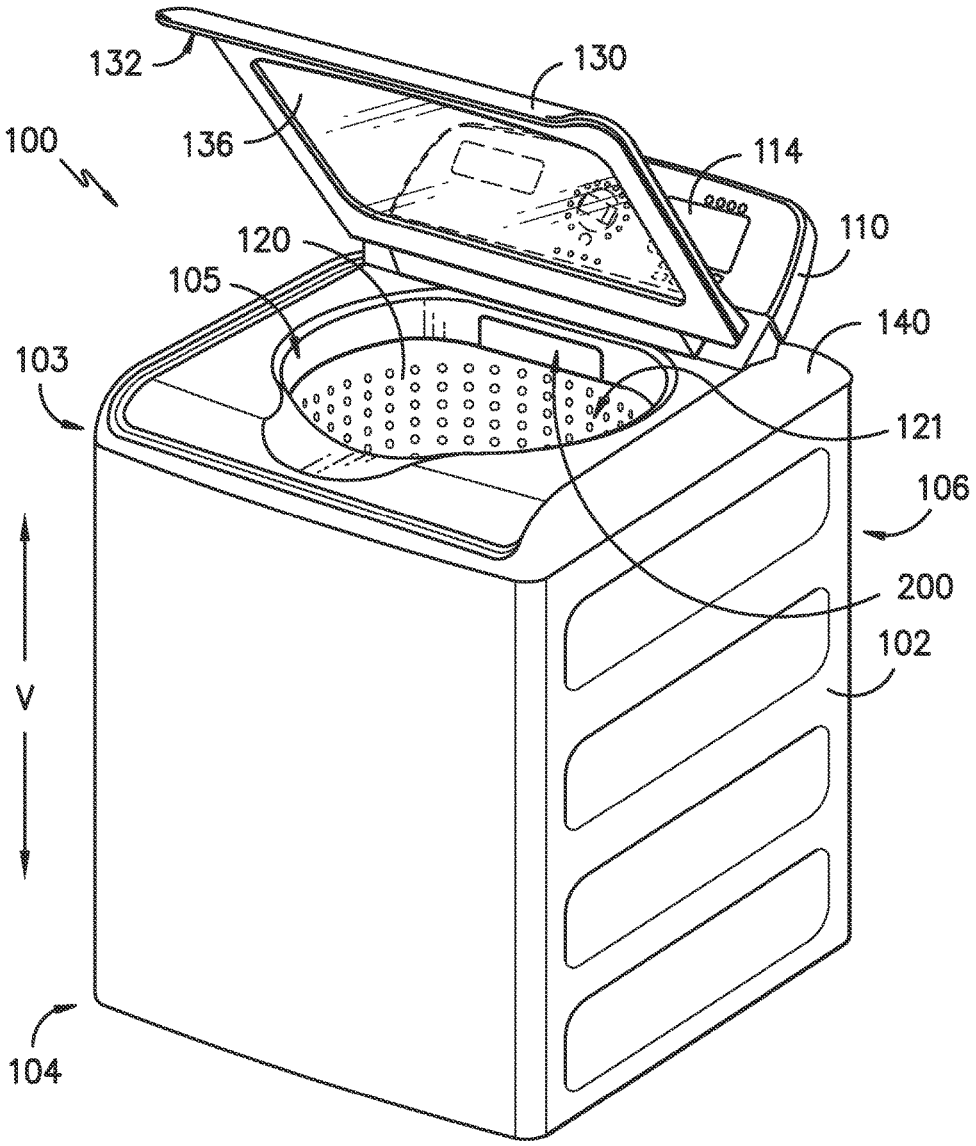
FIG. 2 illustrates the exemplary embodiment of a washing machine shown in FIG. 1 except with the door shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top 103 and a bottom 104 along a vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any outer suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device (not shown) that is operatively coupled to control panel 110 for user manipulation to select washing machine cycles and features. In response to user manipulation of control panel 110, the controller operates the various components of washing machine appliance 100 to execute selected machine cycles and features.

Top panel 140 includes at least one fluid additive dispenser 200 (FIG. 2) for receipt of one or more fluid additives, e.g., detergent, fabric softener, and/or bleach. While only one fluid dispenser will be described herein, it will be understood that multiple fluid dispensers may be used in alternative embodiments of the invention. Fluid additive dispenser 200 (FIG. 3) is positioned near wash tub 121; in FIG. 2, dispenser 200 is depicted at a vertical position above wash tub 121 near back panel 106 of cabinet 102, but dispenser 200 could be positioned in other locations as well. Fluid additive dispenser 200 is described in greater detail below.

In an illustrative embodiment, laundry items are loaded into wash basket 120 through opening 105, and washing operation is initiated through operator manipulation of input selectors 112. Wash basket 120 is filled with water and detergent and/or other fluid additives from e.g., dispenser 200, to form wash and rinse fluids. One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

Figure 3:
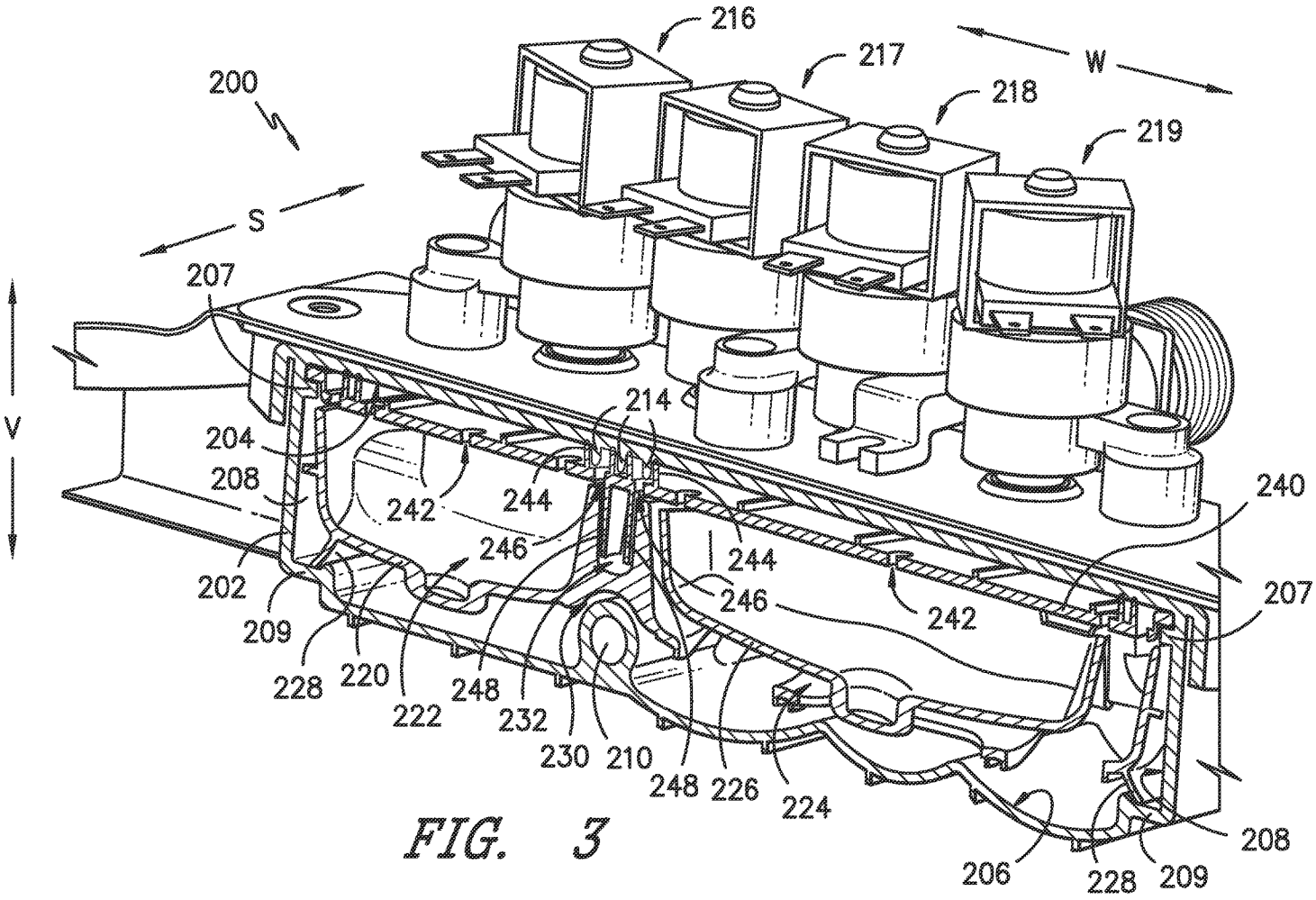
FIG. 3 is a cross-sectional view of an exemplary embodiment of a fluid dispenser of the present invention.

FIG. 3 is a cross-sectional view of an exemplary embodiment of a fluid additive dispenser 200. Fluid additive dispenser 200 includes a housing 202 that has an upper surface 204, lower surface 206, and opposing side surfaces 208. As shown, a dispenser drawer 220 is slidably received in housing 202. More particularly, dispenser drawer 220 includes a foot 228 on either side that slides along a sliding direction S on a ledge 209 defined by lower surface 206 of dispenser housing 202. A ledge 209 is defined adjacent each opposing side surface 208. Further, dispenser drawer 220 defines a groove portion 230 that slides over water channel 210 formed in lower surface 206 of housing 202.

Dispenser drawer 220 includes compartments 222, 224 for the receipt of fluid additives such as fabric softener, detergent, bleach, and the like. Compartments 222, 224 may be configured to receive a dispenser cup, such as the removable dispenser cup 226 disposed in compartment 224 as illustrated in FIG. 3. Moreover, dispenser drawer 220 defines a gap 232 between compartments 222, 224. In alternative embodiments, dispenser drawer 220 may be configured with one, two, or three or more compartments, and for drawers having more than one compartment, a gap may or may not be defined between adjacent compartments. In still other embodiments, more than one compartment may be configured to receive a dispenser cup for the receipt of a fluid additive.

As shown in FIG. 3, valves 216, 217, 218, 219 are located near housing 202 to control the flow of hot and cold water into fluid additive dispenser 200 to convey fluid additives to wash basket 120. A given valve may control the flow of hot or cold water into an associated compartment of dispenser drawer 220. For example, in the exemplary embodiment illustrated in FIG. 3, valve 216 provides a flow of cold water to housing 202 that is used to flush compartment 222 of dispenser drawer 220. Similarly, valve 218 provides a flow of cold water and valve 219 provides a flow of hot water to housing 202 used to flush compartment 224 of dispenser drawer 220. Valve 217 provides a flow of cold water through water channel 210 to a spray nozzle (not shown), which provides a spray of water into wash basket 120. In alternative embodiments, valve 217 could provide water to a compartment of dispenser drawer 220. In still other embodiments, fewer or more than four valves could supply water to dispenser drawer 220 to flush one or more fluid additives from one or more compartments of the drawer.

Whether hot or cold water is supplied to a given compartment of dispenser drawer 220 may depend on the wash cycle selected by a user of washing machine appliance 100. Alternatively, one or more compartments of dispenser drawer 220 may be designated to receive a particular fluid additive, and whether hot or cold water is supplied to a given compartment may depend on the compartment's designated fluid additive.

Additionally, each compartment 222, 224 defines an outlet (not shown) for the flow of a mixture of water and fluid additive from the compartment to the wash basket 120. The mixture of water and fluid additive may flow from housing 202 directly to wash basket 120, e.g., through an opening between dispenser drawer 220 and lower surface 206, or the mixture may be conveyed to wash basket 120 through, e.g., pipes, tubes, or the like. As described above, the mixture of water and fluid additive flows to wash basket 120 to form a wash and/or rinse fluid for cleaning laundry articles contained in wash basket 120.

As shown in FIG. 3, a plate 240 is disposed in housing 202 below upper surface 204 such that a gap is defined between plate 240 and upper surface 204 along the vertical direction V. Plate 240 defines a plurality of apertures 242 (FIG. 5) for the flow-through of water introduced into housing 202 from valves 216, 217, 218, 219 to compartments 222, 224. The plurality of apertures control the flow of water into each compartment 222, 224, creating a shower-like flow into each compartment rather than allowing a deluge of water in one area of the compartment, which could hinder the complete flushing of the fluid additive from the compartment. The flow of water into the compartment through apertures 242 flushes the fluid additive contained in the respective compartment 222, 224 from the compartment through its outlet, providing the mixture of water and the fluid additive to wash basket 120.

Figure 4:
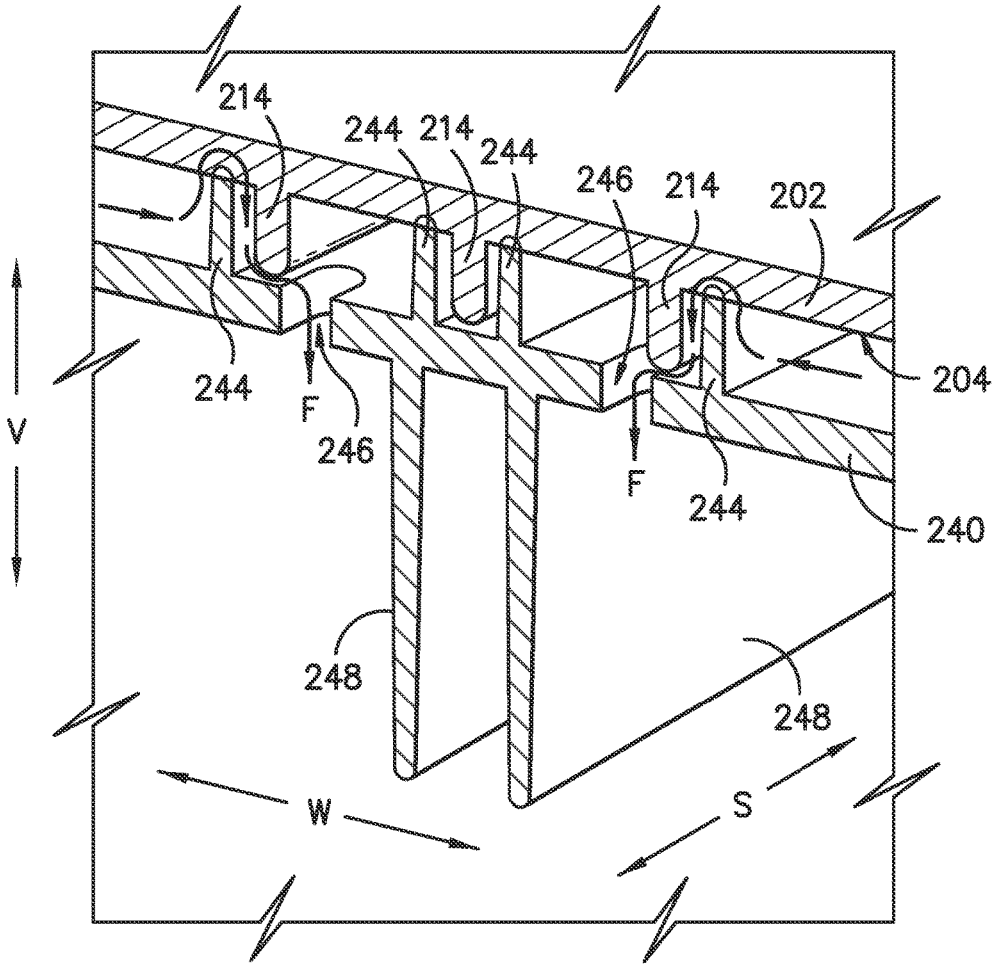
FIG. 4 is a cross-sectional view of a portion of the exemplary embodiment of the fluid dispenser of FIG. 3.

As illustrated in FIGS. 3 and 4, plate 240 also defines a plurality of plate projections 244. Plate projections 244 extend upwardly along the vertical direction V and longitudinally along the sliding direction S and are spaced apart along the width direction W. Further, the upper surface 204 of housing 202 defines a plurality of projections 214 extending downwardly along the vertical direction V and longitudinally along the sliding direction S that are spaced apart along the width direction W. In certain embodiments, each plate projection 244 is co-extensive with each upper surface projection 214.

Moreover, as shown in FIG. 4, plate 240 is secured in housing 202 via an interference fit between the two components, with plate 240 contacting upper surface 204 and support members 207 defined by side surfaces 208 of housing 202. An upper surface projection 214 is located between each adjacent pair of plate projections 244. Alternating upper surface projections 214 and plate projections 244 form a seal that prevents water introduced into housing 202 from prematurely entering a compartment of dispenser drawer 220. In addition, the seal formed by projections 214, 244 prevents a fluid additive in one compartment from entering another compartment. For example, the seal formed by projections 214, 244 prevents the fluid additive in compartment 222 from entering compartment 224 and prevents the fluid additive in compartment 224 from entering compartment 222. Using upper surface projections 214 and plate projections 244 to isolate the compartments of dispenser drawer 220 eliminates the need to use welding, gluing, or another adhesive or manufacturing process to form a seal, which lowers the manufacturing time and cost of washing machine appliance 100.

Additionally, as shown in FIGS. 3 and 4, plate 240 includes guide members 248. When dispenser drawer 220 is received in housing 202, guide members 248 are located in gap 232 defined between compartments 222, 224. Guide members 248 help position and guide dispenser drawer 220 as the drawer slides into and out of housing 202.

Figure 5:
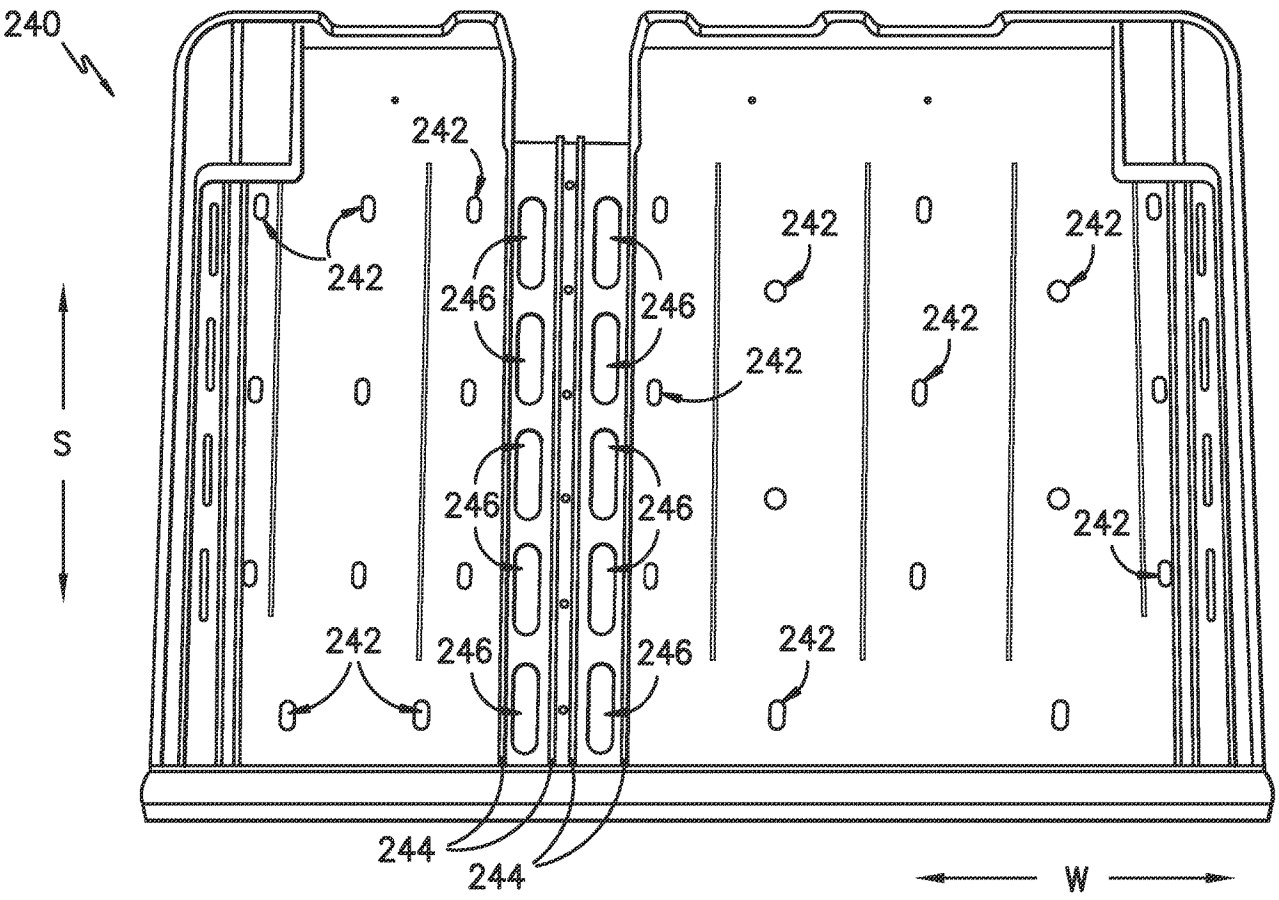
FIG. 5 is a top view of a plate of the exemplary embodiment of the fluid dispenser of FIG. 3.

Referring now to FIGS. 4 and 5, plate 240 defines a plurality of relief slots 246 between adjacent plate projections 244. In the illustrated embodiment, no relief slots 246 are defined between the central pair of plate projections; however, in alternative embodiments, relief slots 246 may be defined between the central pair of plate projections. As shown by arrows F in FIG. 4, relief slots 246 allow any water that penetrates the outermost barrier formed by a plate projection 244 and an upper surface projection 214 to flow into the designated compartment of dispenser drawer 220 rather than into another compartment of the dispenser drawer. In other embodiments, relief slots 246 may allow water to escape to an area between compartments of dispenser drawer 220 and be drained from dispenser drawer 220 by any suitable outlet, such as an outlet defined in lower surface 206 of housing 202.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A washing machine appliance defining a vertical direction, the washing machine appliance comprising:

a cabinet;

a wash tub located within the cabinet;

a wash basket rotatably mounted within the wash tub; and, a fluid additive dispenser defining a sliding direction and a width direction, the fluid additive dispenser comprising a housing having an upper surface and a lower surface, the upper surface defining a plurality of upper surface projections extending downwardly along the vertical direction;

a dispenser drawer slidably received in the housing, the dispenser drawer having a plurality of compartments for the receipt of one or more fluid additives; and, a plate disposed in the housing below the upper surface, the plate defining a plurality of plate projections extending upwardly along the vertical direction, wherein at least one upper surface projection is located between each adjacent pair of plate projections such that the upper surface projections and plate projections alternate along the width direction.

2. The washing machine appliance as in claim 1, wherein the plate further defines a plurality of apertures for the flow-through of water to the compartments of the dispenser drawer.

3. The washing machine appliance as in claim 1, wherein the plate further defines a plurality of relief slots defined between adjacent plate projections.

4. The washing machine appliance as in claim 1, further comprising a plurality of valves for controlling the flow of water into the housing.

5. The washing machine appliance as in claim 4, wherein at least one valve is associated with each compartment of the dispenser drawer, the at least one valve configured to control the flow of water into the associated compartment.

6. The washing machine appliance as in claim 1, wherein the upper surface projections extend along the sliding direction.

7. The washing machine appliance as in claim 1, wherein the plate projections extend along the sliding direction.

8. The washing machine appliance as in claim 1, wherein each plate projection is co-extensive with each upper surface projection.

9. The washing machine appliance as in claim 1, wherein the fluid additive dispenser is located at a vertical position above the wash tub.

10. The washing machine appliance as in claim 1, wherein at least one compartment of the dispenser drawer is configured to receive a removable dispenser cup.

* * * * *